US005226238A

United States Patent [19]

Rahnefeld

[11] Patent Number: 5,226,238

[45] Date of Patent: Jul. 13, 1993

[54] INFINITE SQUARE

[76] Inventor: Paul E. Rahnefeld, 3541-B Forest Branch Dr., Port Orange, Fla. 32119

[21] Appl. No.: 901,958

[22] Filed: Jun. 22, 1992

[51] Int. Cl.[5] ..... B43L 7/10

[52] U.S. Cl. ..... 33/419; 33/425

[58] Field of Search ..... 33/419, 418, 422, 424, 33/425, 426, 474, 475, 479

[56] References Cited

U.S. PATENT DOCUMENTS

| | | | |
|---|---|---|---|
| 303,861 | 8/1884 | King | 33/419 |
| 405,432 | 6/1889 | Pratt | 33/419 |
| 458,606 | 9/1891 | Weaver | 33/419 |
| 530,060 | 11/1894 | Amos | 33/419 |
| 631,536 | 8/1899 | Bradsby | 33/419 |
| 911,330 | 2/1909 | Randall | 33/419 |
| 970,625 | 9/1910 | Krajicek | 33/419 |
| 1,091,332 | 3/1914 | Hart | 33/419 |
| 1,139,648 | 5/1915 | Demmer | 33/419 |
| 1,526,223 | 2/1925 | Koile | 33/418 |
| 1,834,389 | 12/1931 | Drescher | 33/418 |
| 2,412,084 | 12/1946 | Gieske | 33/419 |
| 2,618,859 | 11/1952 | Coleman | 33/419 |
| 4,776,250 | 10/1988 | Julius | 33/474 |

FOREIGN PATENT DOCUMENTS

| | | | |
|---|---|---|---|
| 24495 | 7/1906 | Fed. Rep. of Germany | 33/419 |

*Primary Examiner*—William A. Cuchlinski, Jr.
*Assistant Examiner*—C. W. Fulton
*Attorney, Agent, or Firm*—Michael K. Gray

[57] ABSTRACT

A drawing aid device having a base upon which is positioned a rotating cap. The rotating cap is provided with a slot guide which fits into the slot provided in a drawing and measuring device. The drawing and measuring device is provided with a first sliding region and a second sliding region with the slot of the drawing and measuring device being centrally located therebetween. The rotating cap is provided with first and second slide passages for accommodating the first and second sliding regions of the drawing and measuring device. A pivot screw is screwable into a knurled threaded nut and a ridged threaded nut positioned on opposite sides of the rotating cap. A latitudinal aperture in the rotating cap defines a rotational axis which passes through the knurled threaded nut, ridged threaded nut and pivot screw. The rotating cap and drawing and measuring device are rotatable about the rotational axis.

17 Claims, 4 Drawing Sheets

INFINITE SQUARE

FIELD OF THE INVENTION

The present invention generally relates to T-squares and protractors and to instruments which are used to aid in the drawing of angles and geometric shapes upon a writing surface.

BACKGROUND OF THE INVENTION

The prior art demonstrates a number of devices to aid in the drawing of geometric shapes and angles. U.S. Pat. No. 405,432 to Pratt discloses a device having a base to which is attached, by means of a bolt, a rectangular plate. The bolt is transversely slotted to accommodate a blade. The plate is provided with a slot which adjoins the slot of the bolt to allow the blade to slide in the aforementioned slots for purposes of linearly adjusting the blade. The plate is pivotable about the bolt to allow for rotation of the plate upon the base.

U.S. Pat. No. 458,606 to Weaver discloses a T-square having a blade upon which is provided a slotted plate for allowing rotation of the blade about a screw which is situated upon a head or base member. U.S. Pat. No. 970,625 to Krajicek discloses a T-square which is provided with a longitudinal slot. A slide piece is slidable along the length of the slot and is connected to a disk. The slide piece and disk allow a rule to pivot within and slide along the longitudinal slot.

U.S. Pat. No. 1,139,648 to Demmer discloses a combination tool having a scale which can be adjusted linearly and rotated about and to the side of a center pin. U.S. Pat. No. 530,060 to Amos discloses a T-square having a bar which is pivotally connected within a slot of the T-square so as to be linearly adjustable. U.S. Pat. No. 2,412,084 to Gieske discloses a protractor having an arm which can be adjusted linearly and rotated about a stud.

However, notwithstanding the prior art, the present invention introduces a drawing aid device which is simple in construction, economical, more easily adjustable than prior art devices and quickly adaptable for use on either side of an object to be drawn on.

SUMMARY OF THE INVENTION

Accordingly one object of the present invention is to provide a drawing aid device which is of economical and of simple construction and which is easily adjustable to aid in the drawing and measurement of geometric shapes and designs;

Yet another object of the present invention is to provide a drawing-aid device which is easily adaptable for use on either side of an object to be drawn on.

Still another object of the present invention is to provide a drawing-aid device which facilitates the drawing of mirror images.

These and other valuable objects and advantages of the present invention are provided by a drawing-aid device having a base with a latitudinal aperture which extends through the base. The base is provided with a reference edge for alignment with an edge of an object to be drawn on. A drawing and measuring member having a first sliding region and a second sliding region is connectable to the base. The drawing and measuring member is provided with a slot with is centrally positioned between the first sliding region and the second sliding region. The drawing and measuring member can comprise a T-square, a 90° square, a ruler or any other number of instruments.

The drawing-aid device further includes a rotating cap having a latitudinal aperture which extends through the center of the rotating cap. The rotating cap is provided with a slot guide for fitting into the slot of the drawing and measuring member. The rotating cap has a first slide passage for accommodating the first sliding region of the drawing and measuring member and a second slide passage for accommodating the second sliding region of the drawing and measuring member, the first and second slide passages being separated by the slot guide.

The drawing-aid device of the present invention has means for securing the drawing and measuring member and the rotating cap to the base. The means for securing comprises a ridged threaded nut, a knurled threaded nut, and a knurled pivot screw. The ridged threaded nut fits into the latitudinal aperture of the base so as to be rotatable therein. The ridged threaded nut is provided with a first side edge which makes contact with the first sliding region of the drawing and measuring member and a second side edge which makes contact with the second sliding region of the drawing and measuring member. The ridged threaded nut has a ridge which extends above and between the first side edge and the second side edge for purposes of extending into the slot of the drawing and measuring member. The ridged threaded nut has a circular flange area located opposite to the ridge of the ridged threaded nut, the circular flange area having a diameter greater than the diameter of the latitudinal aperture of the base.

The knurled threaded nut has a bottom portion which fits inside a circular flange formed around the latitudinal aperture on the top of the rotating cap. The knurled pivot screw is screwable into the knurled threaded nut and into the ridged threaded nut so as to secure the rotating cap and the drawing and measuring member to the base.

A pair of guide pins are positioned upon the base and aligned with the reference edge of the base. The guide pins can be removed or inserted into the base as desired.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 7 is a side-view illustration depicting how the device of the present invention is used to draw and measure angles and shapes on the underside of an object to be drawn on;

When referring to the drawings, it should be understood that like reference numerals designate identical or corresponding parts throughout the respective figures.

THE DETAILED DESCRIPTION OF THE INVENTION

Figure 1:
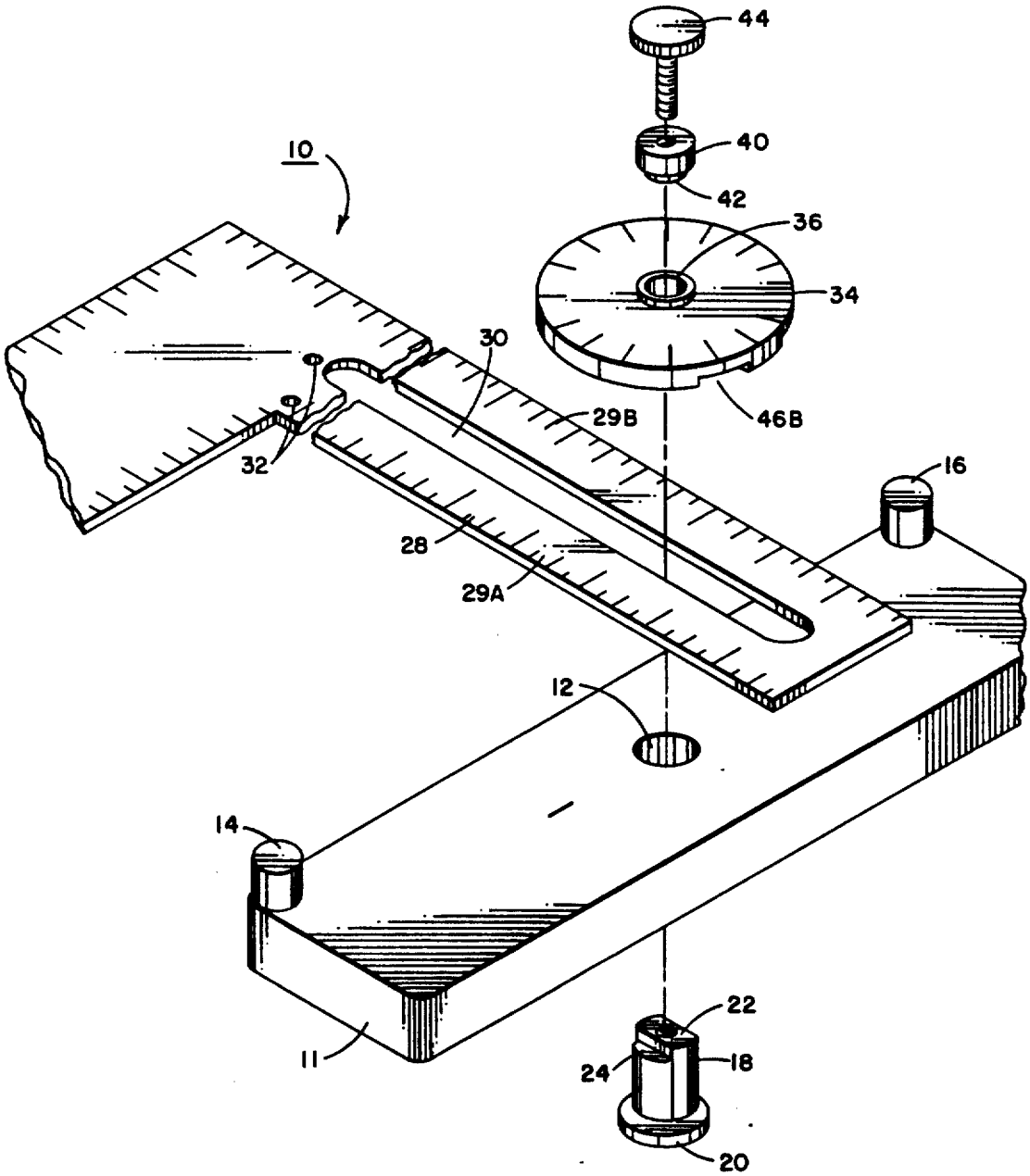
FIG. 1 is an exploded view of the drawing-aid device or infinite square of the present invention.

With reference to the exploded-view of FIG. 1, the drawing-aid device 10 of the present invention has a base 11 which is provided with a latitudinal aperture 12. A guide pin 14 and a guide pin 16 are positioned on the base 11. The guide pins 14 and 16 are in alignment with a reference edge 56 of the base 11 (see FIGS. 6 and 7). The guide pins 14 and 16 are preferably insertable or screwed into the base 11 so the guide pins 14 and 16 can be easily removed from or connected to the base 11.

A ridged threaded nut 18 is fittable into the aperture 12 so as to be rotatable therein. A drawing and measuring member 28 is provided with a first sliding region 29A and a second sliding region 29B. A slot 30 is centrally positioned between the first sliding region 29A and the second sliding region 29B. A ridge 22 of the ridged threaded nut 18 is for insertion into the slot 30 of the drawing and measuring member 28. The drawing and measuring member 28 is provided with pencil holes 32 to aid in the drawing of various shapes and lines.

Still with reference to FIG. 1, the top 35 of rotating cap 34 is provided with a flange 36 which is formed around a latitudinal and centrally positioned aperture 37. A rotating axis indicated by numeral 39 extends through the center of the rotating cap 34 and through the center of the centrally positioned aperture 37. The rotating axis 39 is perpendicular to the top 35 of rotating cap 34. A knurled threaded nut 40 has a bottom portion 42 which is insertable inside the flange 36. A knurled pivot screw 44 is screwable into the knurled threaded nut 40 and into the ridged threaded nut 18 for purposes of securing together the ridged threaded nut 18, the base 11, the drawing and measuring member 28, the rotating cap 34, and the knurled threaded nut 40. When the drawing-aid device of the present invention is assembled, the rotating axis 39 extends through the center of the knurled pivot screw 44, through the center of the knurled threaded nut 40, through the center of the rotating cap 34, and through the center of the ridged threaded nut 18. The drawing and measuring member 28 is perpendicular to the rotating axis 39 and rotates about the rotating axis 39.

Figure 2:
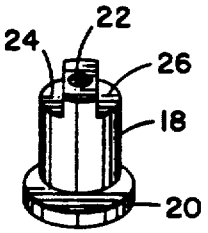
FIG. 2 is a bottom view, perspective illustration of the underside of the rotating cap of the drawing-aid device of the present invention.

With reference to FIG. 2, the underside 38 of the rotating cap 34 has a slot guide 47 at the center of which is located a recessed circular area 50 which forms the periphery around aperture 37. A first peripheral plateau region 48 is located to one side of the slot guide 47 and a second peripheral plateau region 49 is located to the other side of the slot guide 47. Between the slot guide 47 and the first peripheral plateau region 48 is positioned a first slide passage 45 into which the first sliding region 29A of the drawing and measuring member 28 is accommodated. Between the slot guide 47 and the second peripheral plateau region 49 is positioned a second slide passage 46 into which is accommodated the second sliding region 29B of the drawing and measuring member 28 (see FIG. 1). Those regions of the first and second plateau regions 48 and 49 and the slot guide 47 which are furthest from the top 35 (FIG. 1) of the rotating cap 34 are in a parallel plane. The first and second slide passages 45 and 46 are grooved out regions which allow the sliding regions 29A and 29B of measuring and drawing member 28 (FIG. 1) to slide therein, respectively.

Figure 3:
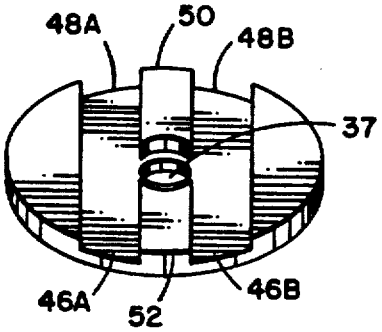
FIG. 3 is side-view, perspective illustration of the ridged threaded nut of the drawing-aid device of the present invention.

With reference to the side-view illustration of the ridged threaded nut 18 of FIG. 3, the ridged threaded nut 18 has a ridge 22 which separates side edge 24 and side edge 26. When the drawing-aid device 10 of the present invention is assembled, the ridge 22 is inserted into the slot 30 of drawing and measuring member 28 and the side edge 24 makes contact with the first sliding region 29A and the side edge 26 makes contact with the second sliding region 29B (see FIG. 1). When the device of the present invention is assembled, the ridge 22 is positioned at the recessed circular center area 50 of the rotating cap 34 (see FIG. 2). The ridged threaded nut 18 is further provided with a circular flange region 20 which has a diameter which is greater than the diameter of the latitudinal aperture 12 of the base 11.

Figure 4:
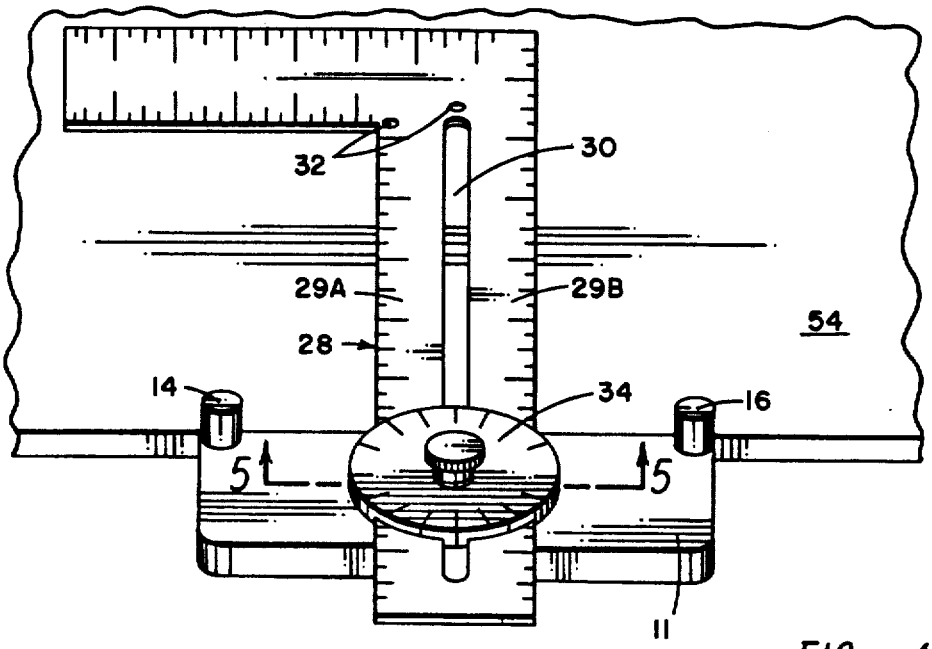
FIG. 4 is a perspective illustration of the drawing aid device of the present invention which is shown situated adjacent to an object to be drawn upon.

In FIG. 4, a perspective illustration depicts the drawing-aid device 10 of the present invention positioned on and adjacent to an object to be drawn upon 54. In practice the object to be drawn upon can be such things as a table, a piece of plastic or wood, or any other object which might be drawn upon or which supports an object to be drawn upon. The drawing and measuring member 28 is situated upon the top surface 54A of the object 54. The base 11 is positioned against the edge 55 of the object to be drawn on 54.

Figure 5:
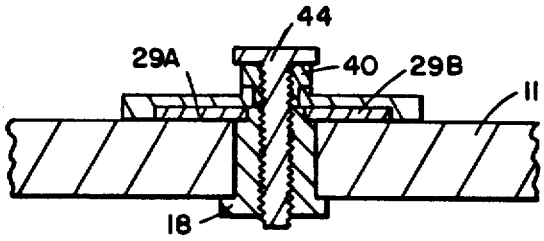
FIG. 5 is a cross-sectional illustration taken along line 5—5 of FIG. 4.

In FIG. 5, a cross-sectional illustration taken along line 5—5 of FIG. 4 demonstrates that the knurled pivot screw 44 extends through the knurled threaded nut 40 and the ridged threaded nut 18 for purposes of securing the drawing and measuring member 28 and rotating cap 34 to the base 11. FIG. 5 further serves to demonstrate how the sliding regions 29A and 29B of the drawing and measuring member 28 are positioned upon the side edges 24 and 26, respectively, of the ridged threaded nut 18.

Figure 6:
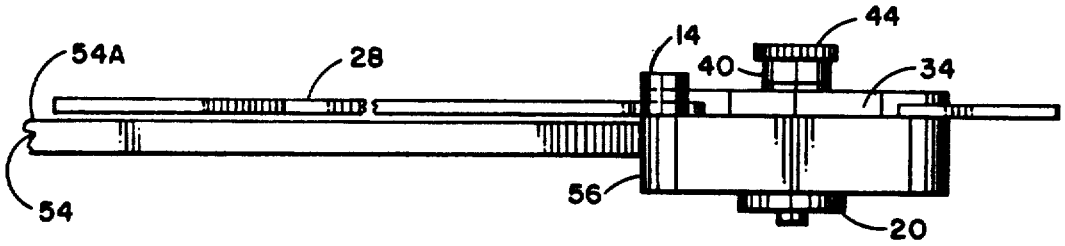
FIG. 6 is a side-view illustration depicting how the device of the present invention is used to draw and measure angles and shapes on the top side of an object to be drawn upon.

In FIG. 6, a side-view illustration demonstrates how an object to be drawn upon 54 is aligned with the reference edge 56 of the drawing-aid device 10 of the present invention so as to properly align the drawing and measuring member 28 upon the top surface 54A of the object 54.

Figure 7:
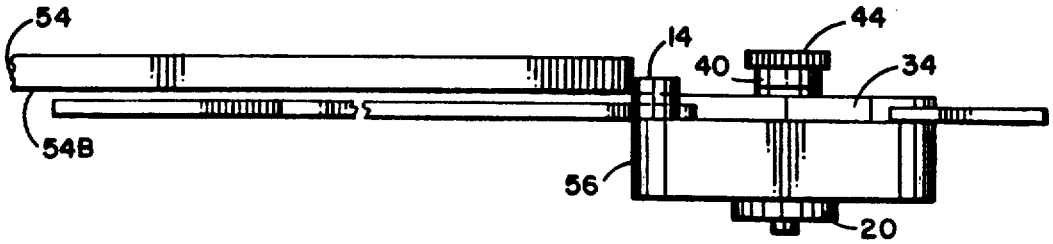

The side-view illustration of FIG. 7 demonstrates how the guide pins 14 and 16 (FIG. 1) can be used to properly align an edge 55 of an object to be drawn upon 54 so that drawing and measuring member 28 can be effectively utilized on the underside 54B of the object 54. Guide pin 14 is in alignment with reference edge 56 of the drawing aid device 10 of the present invention. With guide pin 14 touching the reference edge 55 of the object 54, the drawing and measuring member can be used on the underside of the object 54. Carpenters can appreciate the fact that it is sometimes desirable to make markings on the underside of a piece of wood. The carpenter application is but one example of how the pins 14 and 16 can be of great assistance to a user.

Figure 8:
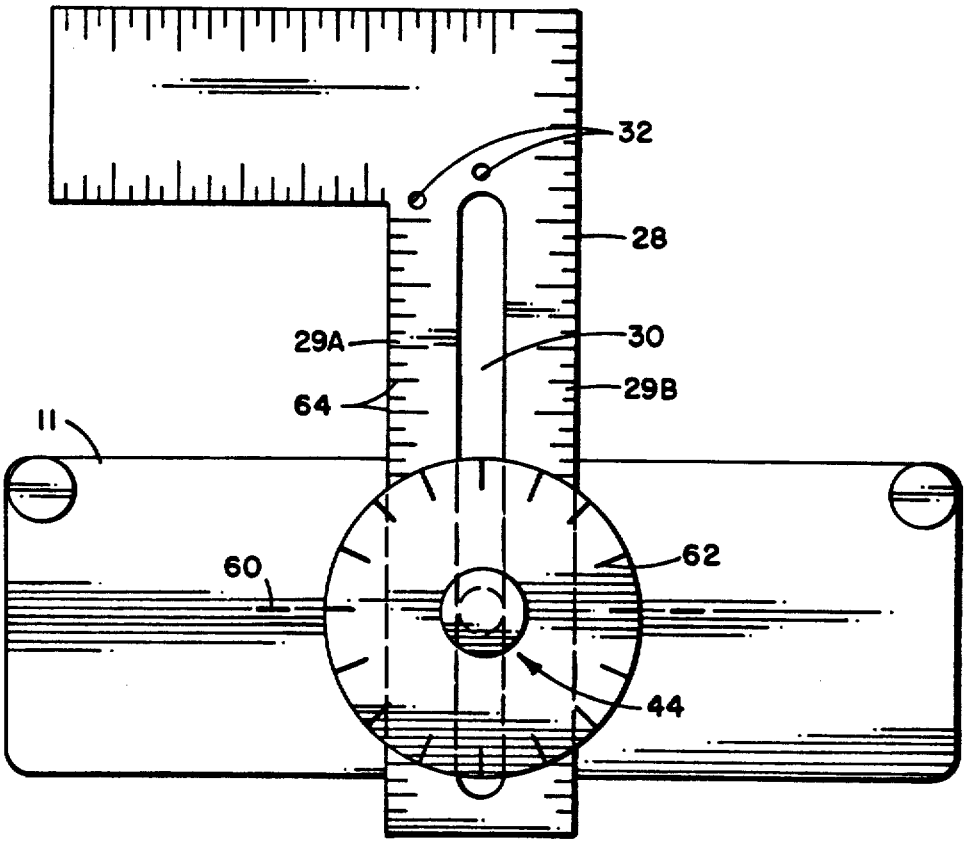
FIG. 8 is a top view of the drawing-aid device of the present invention.

FIG. 8 is a top view of the present invention and demonstrates that the top 35 of rotating cap 34 is provided with degree markings 62. By utilizing the reference mark 60 located on the base 11, the drawing and measuring member 28 can be rotated and secured at any desired angle. The drawing and measuring member 28 is provided with measuring lines 64 for purposes of taking measurements.

Figure 9:
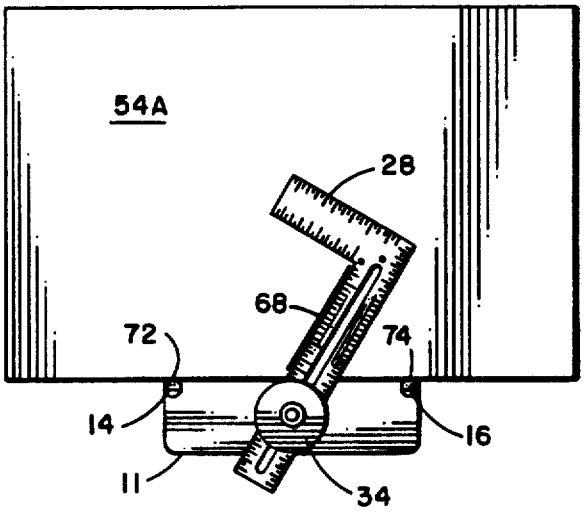
FIG. 9 is top-view illustration which exemplifies how the drawing aid device of the present invention is used to draw a line upon an object to be drawn upon.

In FIG. 9, the drawing-aid device 10 of the present invention is positioned adjacent the object to be drawn upon 54. Guide pin 14 is aligned with point 72 on the object to be drawn upon and guide pin 16 is aligned with point 74 of the object to be drawn upon 54. Drawing and measuring member 28 is flush upon the top 54A of the object to be drawn upon 54 for purposes of drawing line 68.

Figure 10:
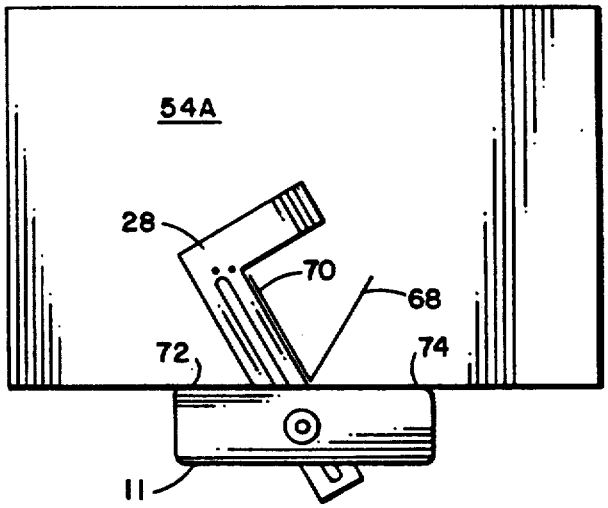
FIG. 10 is a top view illustration which exemplifies how the drawing-aid device of the present invention can be flipped over for purposes of forming angles and mirror images on an object to be drawn upon without need of further adjustment of the device.

In FIG. 10, the drawing-aid device 10 has been flipped over so that guide pin 16 which was aligned with point 74 in FIG. 9 is aligned with point 72 and guide pin 14 which was aligned with point 72 in FIG. 9 is aligned with point 74 (guide pins 14 and 16 are not shown in FIG. 10.). In FIG. 10, the drawing and measuring member 28 has not been adjusted linearly or angularly from the position depicted in FIG. 9. Like the rest of the drawing-aid device 10, the drawing and measuring member (FIG. 9) has been flipped over so that line 70 can be drawn without further need of linear or angular adjustment of the drawing and measuring member 28.

Figure 11:
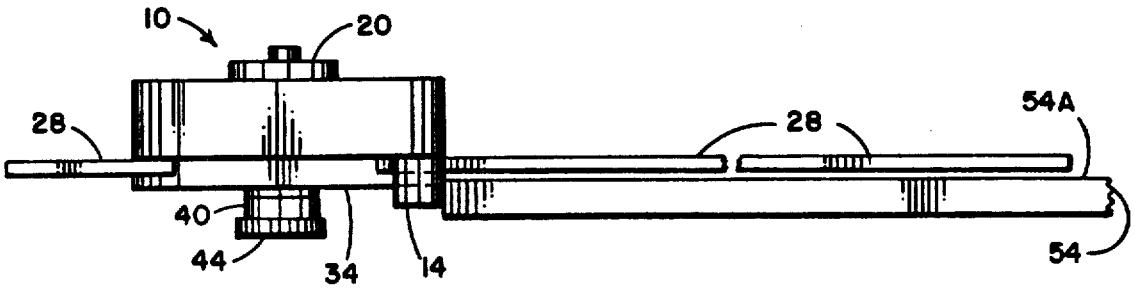
FIG. 11 is a side-view illustration of the drawing-aid device in a flipped-over position such as demonstrated in FIG. 10.

FIG. 11, is a side-view illustration of the drawing-aid device 10 of the present invention in a flipped-over position, such as in FIG. 10. The guide pins 14 and 16 (only guide pin 14 is shown in FIG. 11) are used to position the drawing aid device against the edge 55 of the object to be drawn upon 54. The guide pins 14 and 16 facilitate drawing lines, shapes and mirror images without the need of adjusting the drawing and measuring member 28.

The infinite square or drawing-aid device 10 of the present invention was designed to aid in the drawing of geometric shapes, the marking of angles and the taking of referenced measurements from a single reference edge of a work piece or object to be drawn upon 54. In the past, such drawing and measuring has typically been accomplished by the use of a T-square and triangles having appropriate angles.

The drawing and measuring member 28 is used to take measurements or to draw geometric shapes. The pencil holes 32 in the measuring member 28 facilitate accuracy in drawing. The drawing and measuring member 28 slides linearly in and out of the rotating cap 34 to allow for linear adjustment and the degreed rotating cap 34 can be rotated about the rotating axis 39 (FIG. 1) to allow for angular adjustment of the drawing and measuring member. The degree markings 62 on the rotating cap 34 and the reference mark 60 on the base 11 are used to indicate the angle in degrees between the base 11 and the drawing and measuring member 28.

The knurled pivot screw 44 can be screwed into the knurled threaded nut 40 and the ridged threaded nut 18 (see FIG. 5) to effectively lock the drawing and measuring member 28 into a desired linear and angular location. When an adjustment in angular or linear position is called for, the knurled pivot screw 44 is simply loosened and then tightened once the desired linear and angular coordinates of the drawing and measuring member 28 have been attained. For example, to draw a three inch line at 15 degrees starting four inches from the reference edge 56, simply rotate the rotating cap so that the drawing and measuring aid 28 is at a 15 degree angle to the reference edge 56 and slide the drawing and measuring member out the desired number of inches. Then use the ruler aspect of the drawing and measuring member to draw a three inch object on the object to be drawn on. The infinite square or drawing-aid device of the present invention can be used to draw squares, triangles, and arcs of any size and distance (within the particular size limitations of a given drawing-aid device 10) from the reference edge 56.

The infinite square will be of great use to shop workers, carpenters, drawing professionals and a host of other individuals who must make angular and linear measurement of an object.

The infinite square can be manufactured to any desired size and can be made of a variety of materials (e.g., plastic, wood and metal).

The foregoing detailed description of the present invention is intended to be illustrative and non-limiting. Many changes and modifications are possible in light of the above teachings. Thus, it is understood that the invention may be practiced otherwise than as specifically described herein and still be within the scope of the appended claims.

What is claimed is:

1. A drawing-aid device, comprising:

a base having a latitudinal aperture extending through the base, said base having a reference edge for alignment with an edge of an object to be drawn on;

a drawing and measuring member having a first sliding region and a second sliding region, said drawing and measuring member having a slot which is centrally positioned between said first sliding region and said second sliding region;

a rotating cap having a latitudinal aperture extending through the center of said rotating cap, said rotating cap having a slot guide for fitting into the slot of said drawing and measuring member, said rotating cap having a first slide passage for accommodating said first sliding region and a second slide passage for accommodating said second sliding region, said first and second slide passages being separated by said slot guide;

means for securing said drawing and measuring member and said rotating cap to said base so that said drawing and measuring member and said rotating cap are pivotable upon said base; and wherein the latitudinal aperture of said base defines a fixed rotational axis around which said drawing and measuring member and said rotating cap are pivotable upon said base.

2. A drawing-aid device according to claim 1, further comprising:

a first guide pin and a second guide pin positioned upon said base and aligned with the reference edge of said base for aligning the reference edge of said drawing edge device with an object to be drawn upon and for utilizing said drawing-aid device to draw upon the underside of the object to be drawn upon.

3. A drawing-aid device, comprising:

a base having a latitudinal aperture extending through the base, said base having a reference edge for alignment with an edge of an object to be drawn on;

a drawing and measuring member having a first sliding region and a second sliding region, said drawing and measuring member having a slot which is centrally positioned between said first sliding region and said second sliding region;

a rotating cap having a latitudinal aperture extending through the center of said rotating cap, said rotating cap having a slot guide for fitting into the slot of said drawing and measuring member, said rotating cap having a first slide passage for accommodating said first sliding region and a second slide passage for accommodating said second sliding region, said first and second slide passages being separated by said slot guide;

means for securing said drawing and measuring member and said rotating cap to said base so that said drawing and measuring member and said rotating cap are pivotable upon said base, said means for securing comprising a ridged threaded nut, a knurled threaded nut and a knurled pivot screw; and wherein said ridged threaded nut fits into the latitudinal aperture of said base so as to be rotatable therein, said ridged threaded nut having a first side edge which makes contact with the first sliding region of said drawing and measuring member and a second side edge which makes contact with the second sliding region of said drawing and measuring member, said ridged threaded nut has a ridge which extends above and between said first side edge and said second side edge, said ridge extending into the slot of said drawing and measuring member.

4. A drawing-aid device according to claim 3, wherein:

said rotatable cap has a circular flange formed around the latitudinal aperture on the top of said rotatable cap.

5. A drawing-aid device according to claim 4, wherein:

said knurled threaded nut has a bottom portion which fits inside said circular flange formed around the latitudinal aperture on the top of said rotatable cap.

6. A drawing-aid device according to claim 5, wherein said knurled pivot screw is screwable into the knurled threaded nut and into the ridged threaded nut so as to secure said rotating cap and said drawing and measuring member to said base.

7. A drawing-aid device according to claim 6, wherein said drawing and measuring member is provided with at least one pencil hole.

8. A drawing-aid device according to claim 3, wherein said ridged threaded nut has a circular flange area located opposite to said ridge of said ridged threaded nut, said circular flange area having a diameter greater than the diameter of the latitudinal aperture of said base.

9. A drawing-aid device according to claim 3, wherein:

the underside of said rotating cap has a recessed circular center area for accommodating said ridge of said ridged threaded nut.

10. A drawing-aid device according to claim 9, wherein:

the underside of said rotating cap is provided with a first peripheral plateau region and a second peripheral plateau region, the slot guide of said rotating cap being located between the first and second peripheral plateau regions, the first slide passage is formed between the slot guide and the first peripheral plateau region and the second slide passage is formed between the second peripheral plateau and the slot guide.

11. A drawing-aid device according to claim 10, wherein said recessed circular center area divides the slot guide into two regions.

12. A drawing-aid device according to claim 11, wherein said rotating cap is circular in shape with the top of said rotating cap having degree markings.

13. A drawing-aid device according to claim 12, wherein said base has a reference mark for angle measurement.

14. A drawing aid device according to claim 12, wherein said drawing and measuring member has measurement lines.

15. A drawing aid device according to claim 14, wherein said drawing and measuring member is a 90° square.

16. A drawing aid device according to claim 14 wherein said drawing and measuring member is a ruler.

17. A drawing-aid device, comprising:

a base having a latitudinal aperture extending through the base, said base having a reference edge for alignment with an edge of an object to be drawn on;

a drawing and measuring member having a first sliding region and a second sliding region, said drawing and measuring member having a slot which is centrally positioned between said first sliding region and said second sliding region;

a rotating cap having a latitudinal aperture extending through the center of said rotating cap, said rotating cap having a slot guide for fitting into the slot of said drawing and measuring member, said rotating cap having a first slide passage for accommodating said first sliding region and a second slide passage for accommodating said second sliding region, said first and second slide passages being separated by said slot guide;

a ridged threaded nut connected to said rotating cap;

a knurled threaded nut connected to said rotating cap;

a pivot screw; and wherein said pivot screw is screwable into the ridged threaded nut and said knurled threaded nut for securing together said ridged threaded nut, said base, said drawing and measuring member, said rotating cap and said knurled threaded nut.

* * * * *